US010441080B2

(12) United States Patent
Hall et al.

(10) Patent No.: US 10,441,080 B2
(45) Date of Patent: Oct. 15, 2019

(54) WHEEL CLEANING CHAIR

(71) Applicants: David R. Hall, Provo, UT (US); William H. Reynolds, Orem, UT (US); Justin Robinson, Provo, UT (US); Hyrum Malone, Provo, UT (US); Joe Fox, Spanish Fork, UT (US); Alaina Hirschi, Provo, UT (US)

(72) Inventors: David R. Hall, Provo, UT (US); William H. Reynolds, Orem, UT (US); Justin Robinson, Provo, UT (US); Hyrum Malone, Provo, UT (US); Joe Fox, Spanish Fork, UT (US); Alaina Hirschi, Provo, UT (US)

(73) Assignee: Hall Labs, LLC, Provo, UT (US)

( * ) Notice: Subject to any disclaimer, the term of this patent is extended or adjusted under 35 U.S.C. 154(b) by 166 days.

(21) Appl. No.: 15/661,461

(22) Filed: Jul. 27, 2017

(65) Prior Publication Data

US 2019/0029425 A1 Jan. 31, 2019

(51) Int. Cl.

| | |
|---|---|
| ***A47C 7/62*** | (2006.01) |
| ***A47C 1/00*** | (2006.01) |
| ***A47C 7/00*** | (2006.01) |
| ***A46B 15/00*** | (2006.01) |
| ***A47C 7/72*** | (2006.01) |

(52) U.S. Cl.

CPC ..... *A47C 1/00* (2013.01); *A46B 15/0004* (2013.01); *A46B 15/0036* (2013.01); *A46B 15/0055* (2013.01); *A47C 7/004* (2013.01); *A47C 7/006* (2013.01); *A47C 7/62* (2013.01); *A47C 7/72* (2013.01); *A47C 7/725* (2013.01)

(58) Field of Classification Search

CPC ..... A46B 15/0055; A46B 15/00; B08B 1/002; B60B 33/00; B60S 3/042; Y10T 16/207; Y10T 16/216

USPC ..... 15/53.4, 105, 246, 256.5, 256.51; 297/463.1, 463.2

See application file for complete search history.

(56) References Cited

U.S. PATENT DOCUMENTS

| | | | | | |
|---|---|---|---|---|---|
| 185,660 | A | * | 12/1876 | Bacon | B60S 1/68 280/855 |
| 477,504 | A | * | 6/1892 | Bunker | B62J 6/20 280/158.1 |
| 597,471 | A | * | 1/1898 | Nutsford | B62J 6/20 280/158.1 |
| 597,527 | A | * | 1/1898 | Peate et al. | B62J 6/20 280/158.1 |
| 602,193 | A | * | 4/1898 | Neuert | A46B 9/02 15/160 |
| 649,824 | A | * | 5/1900 | Druschky | B62J 6/20 15/160 |
| 671,320 | A | * | 4/1901 | Nixon | B62J 6/20 15/160 |
| 719,608 | A | * | 2/1903 | Peterson | B62J 6/20 15/160 |
| 951,553 | A | * | 3/1910 | Williams et al. | B60B 33/00 16/18 CG |

(Continued)

*Primary Examiner* — Rodney B White

(57) ABSTRACT

A wheel cleaning chair is disclosed which, in general, includes a chair seat, a chair base, and a column. The column connects the chair seat and the chair base. The chair base includes two or more wheel assemblies. Each wheel assembly includes a wheel casing and a wheel. The wheel assemblies also include a wheel cleaner proximate each wheel.

15 Claims, 12 Drawing Sheets

(56) References Cited

U.S. PATENT DOCUMENTS 2,046,384 A * 7/1936 Katcher ..... B60B 33/00 15/159.1
2,077,919 A * 4/1937 Engstrom ..... B60S 1/68 280/856
2,471,958 A * 5/1949 Humphreys ..... B60B 33/00 16/18 CG
2,740,643 A * 4/1956 Gordon ..... B62B 9/16 280/47.38
3,222,708 A * 12/1965 Butsch ..... B60B 33/00 16/41
3,231,293 A * 1/1966 Loustaunau ..... A61G 5/10 15/160
3,643,905 A * 2/1972 Kint ..... A47B 95/043 248/345.1
3,744,080 A * 7/1973 Smith, Jr. ..... B60B 33/00 15/256.51
4,288,088 A * 9/1981 Harrison ..... A63C 17/1436 280/11.215
4,365,839 A * 12/1982 Strassle ..... A47C 5/12 248/188.7
4,605,239 A * 8/1986 Warfel ..... A61G 5/10 15/160
5,430,906 A * 7/1995 Drury ..... B60S 1/685 15/160
5,542,690 A * 8/1996 Kozicki ..... A61G 5/045 180/907
5,615,450 A * 4/1997 Butler ..... B60B 33/00 16/18 CG
5,857,238 A * 1/1999 Jmill ..... A46B 9/00 15/244.1
6,334,630 B1 * 1/2002 Barros, Sr. ..... A01B 71/08 15/256.5
6,434,781 B1 * 8/2002 Guerra ..... A63B 57/60 15/256.5
9,067,570 B2 * 6/2015 Kueppers ..... B60S 1/685
9,108,462 B1 * 8/2015 Stone ..... B60B 33/0023
9,346,438 B1 * 5/2016 Parker, III ..... B60S 1/68
9,718,446 B1 * 8/2017 Tolbert ..... B60S 3/042
9,944,120 B1 * 4/2018 Butler ..... B60B 33/0063
9,994,198 B1 * 6/2018 Emanuelli ..... B60S 3/041
10,196,048 B2 * 2/2019 Yoon ..... B60B 33/00
2004/0211031 A1 * 10/2004 Cox ..... A47C 7/004 16/18 CG
2006/0010642 A1 * 1/2006 Nickson ..... B60B 7/00 16/18 CG
2014/0284911 A1 * 9/2014 Kueppers ..... B60S 1/68 280/855
2015/0328926 A1 * 11/2015 Illing ..... B60B 33/00 16/18 CG

* cited by examiner

WHEEL CLEANING CHAIR

BACKGROUND

Field of the Invention

This invention relates generally to the field of chair technology, and more specifically to cleaning chairs.

SUMMARY OF THE INVENTION

An invention has been developed in response to present state of the art and, in particular, in response to problems and needs in the art that have not yet been fully solved by currently available systems and methods. Accordingly, a wheel cleaning chair has been developed. Features and advantages of different embodiments of the invention will become more fully apparent from the following description and appended claims, or may be learned by practice of the invention as set forth hereinafter.

A wheel cleaning chair is disclosed which, in general, includes a chair seat, a chair base, and a column. The column connects the chair seat and the chair base. The chair base includes two or more wheel assemblies. Each wheel assembly includes a wheel casing and a wheel. The wheel assemblies also include a wheel cleaner proximate each wheel.

At least one of the wheel cleaners may include a bristle brush. The bristle brush may extend to a contact patch of the corresponding wheel. At least one of the wheel cleaners may include a scraper. The scraper may have a scraper blade. At least one of the wheel assemblies may include an axle. The axle may connect the wheel to the corresponding casing.

At least one of the wheel assemblies may include a stem. The stem may be pivotally attached to the corresponding casing. At least one of the wheels may be spherical. At least one of the wheels may be connected to the corresponding casing via a ball-and-socket joint.

The axle may include a primary gear. The brush may include gear teeth meshed with the primary gear. The scraper may include a secondary gear meshed with the primary gear.

At least one of the wheels may include and be rotatably coupled to an axle. At least one of the wheel assemblies may include an energy harvester coupled to the axle. The wheel cleaning chair may include an energy storage device electrically connected to the energy harvester. The wheel cleaning chair may include a controller electrically connected to the energy storage device. At least one of the wheel assemblies may include a light sensor electrically connected to the controller. At least one of the wheel assemblies may include an audio sensor electrically connected to the controller. At least one of the wheel assemblies may include a particulate matter (PM) sensor electrically connected to the controller.

BRIEF DESCRIPTION OF THE DRAWINGS

A more particular description of the invention briefly described above is made below by reference to specific embodiments. Several embodiments are depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1A:
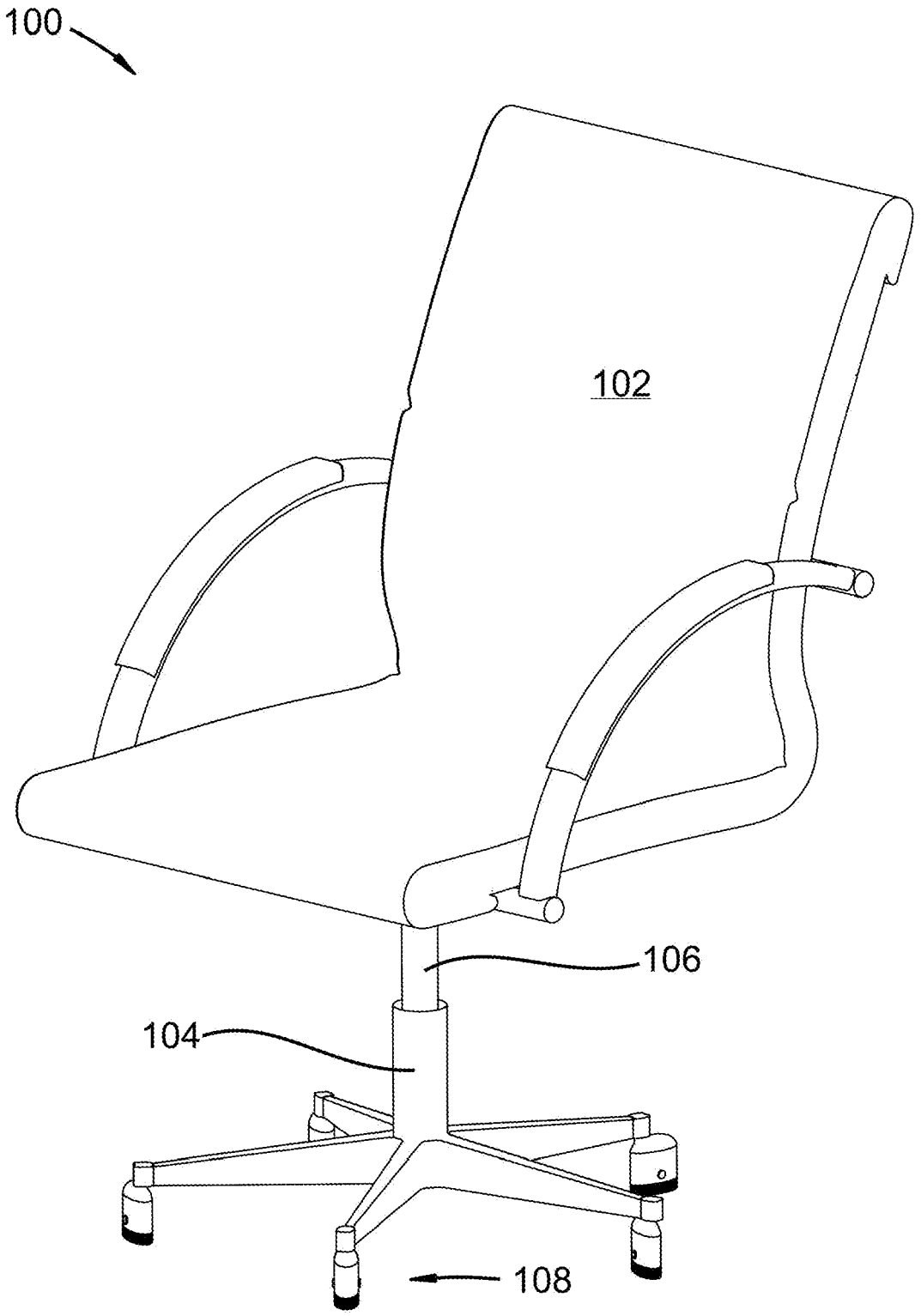
FIG. 1A depicts a perspective view of a wheel cleaning chair.
Figure 1B:
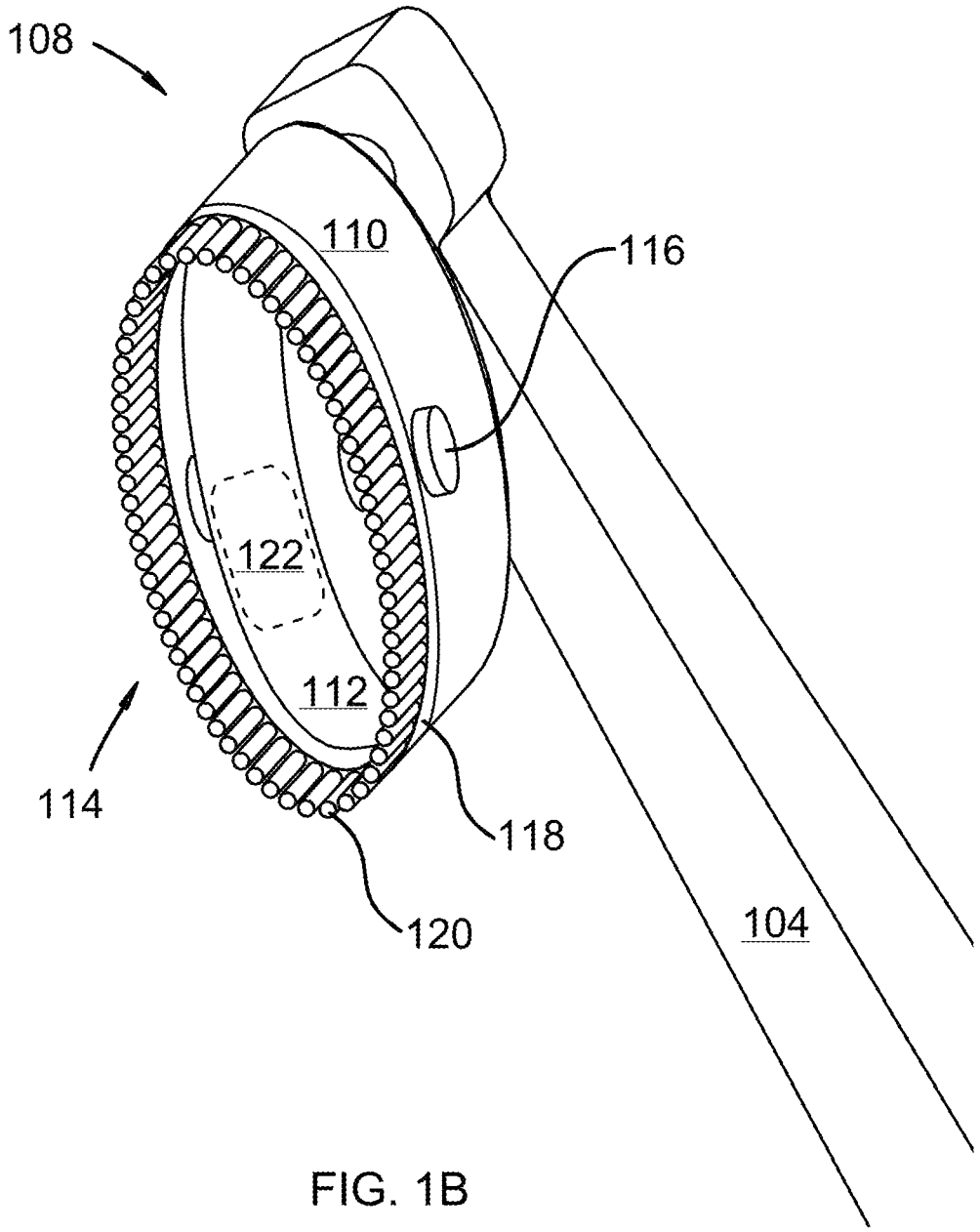
FIG. 1B depicts a perspective bottom-view of a wheel assembly.

FIG. 1A depicts a perspective view of a wheel cleaning chair. FIG. 1B depicts a perspective bottom-view of a wheel assembly. Wheel cleaning chair 100 includes chair seat 102, chair base 104, and column 106. Column 106 connects chair seat 102 to chair base 104. Chair base 104 includes two or more wheel assemblies 108. Wheel assemblies 108 each include wheel casing 110 and wheel 112. Wheel assemblies 108 further include wheel cleaner 114 proximate each wheel. The wheel assembly may comprise an LED wheel illuminator.

Wheel assembly 108 may be pivotally connected to base 104. Column 106 may be pivotally connected to seat 102 or base 104. Wheel assembly 108 may include axle 116. Axle 116 may connect wheel 112 to corresponding casing 110. Wheel 112 may include, and be rotatably connected to axle 116. Casing 110 may be rotatably connected to axle 116.

Wheel cleaner 114 may include bristle brush 118 having bristles 120. Bristles 120 may extend to contact patch 122 of wheel 112, where a contact patch is a portion of a wheel that comes in contact with a surface of a floor. Bristles 120 may include any of a variety of materials, such as hair, straw, metallic wire, nylon, or plastic.

Wheel cleaner 114 may clean wheel 112 and/or a surface with which wheel 112 comes in contact. For example, a user may move wheel cleaning chair 100 along a floor. Wheel cleaner 114 may clean the floor as wheel cleaner 114 moves relative to a surface of the floor. Debris such as strands of hair, dirt, rocks, etc. left on the floor may be collected or displaced by wheel cleaner 114 to prevent the debris from jamming wheel 112 (jamming meaning that debris prevent wheel 112 from rolling).

Figure 2:
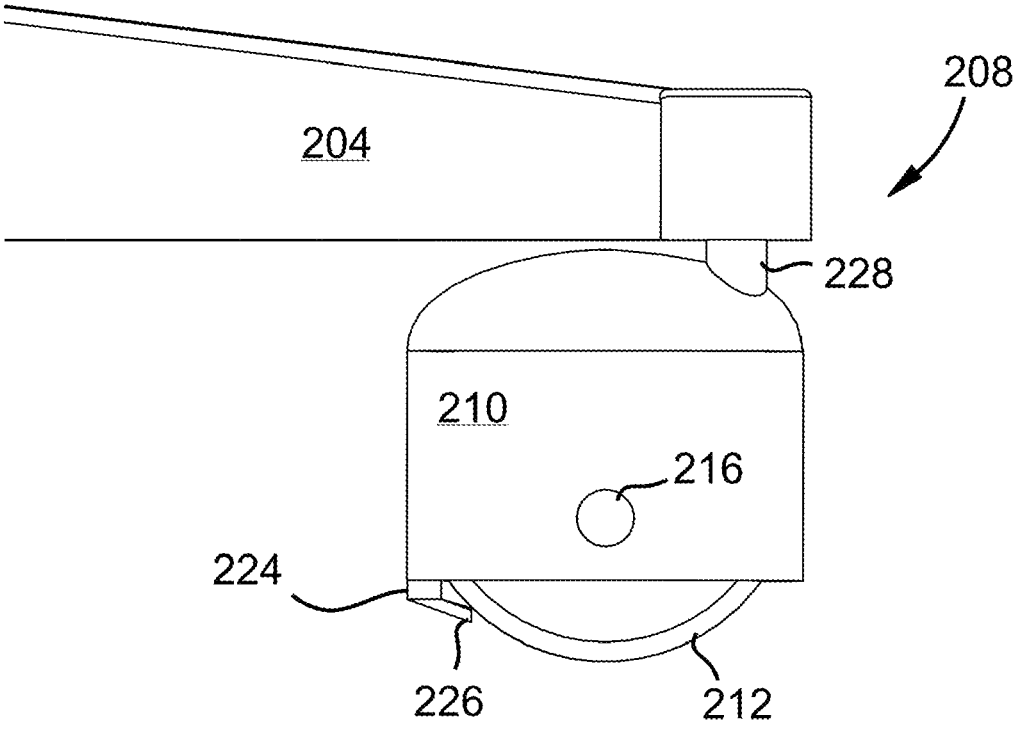
FIG. 2 depicts a side-view of a wheel assembly.

FIG. 2 depicts a side-view of a wheel assembly. Wheel assembly 208 may include wheel 212, casing 210, and scraper 224. Scraper 224 may have scraper blade 226. Scraper blade 226 may be coupled to scraper 224 by any of a variety of means, including fastening, welding, or brazing. The wheel assembly may be illuminated by an LED light.

Wheel assembly 208 may include axle 216. Axle 216 may connect wheel 212 to corresponding casing 210. Wheel assembly 208 may include stem 228. Stem 228 may be pivotally attached to corresponding casing 210. For example, casing 210 may pivot around stem 228 such that it may rotate relative to chair base 204. Stem 228 may be made of any of a variety of materials, including plastic, metal, or ceramic.

Scraper blade 226 may include any of a variety of materials, such as plastic, metal, or ceramic.

Figure 3:
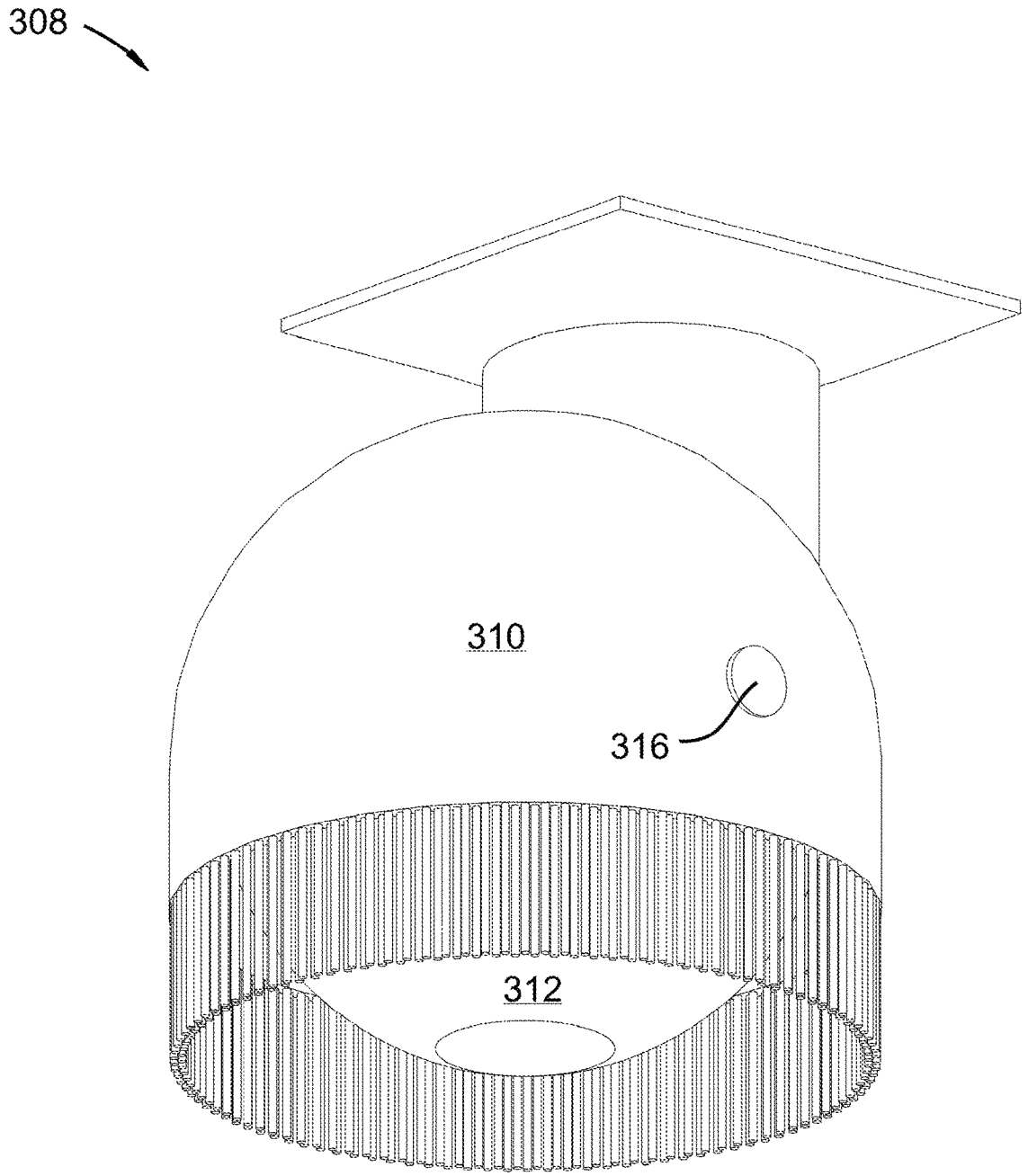
FIG. 3 depicts a perspective view of a wheel assembly with a spherical wheel.

FIG. 3 depicts a perspective view of a wheel assembly with a spherical wheel. Wheel 312 of wheel assembly 308 may be spherical. Wheel assembly 308 may include casing 310 and axle 316. Axle 310 may connect wheel 312 to casing 310 such that wheel 312 may rotate relative to casing 310 while wheel 312 maintains relative translation with casing 310.

Figure 4:
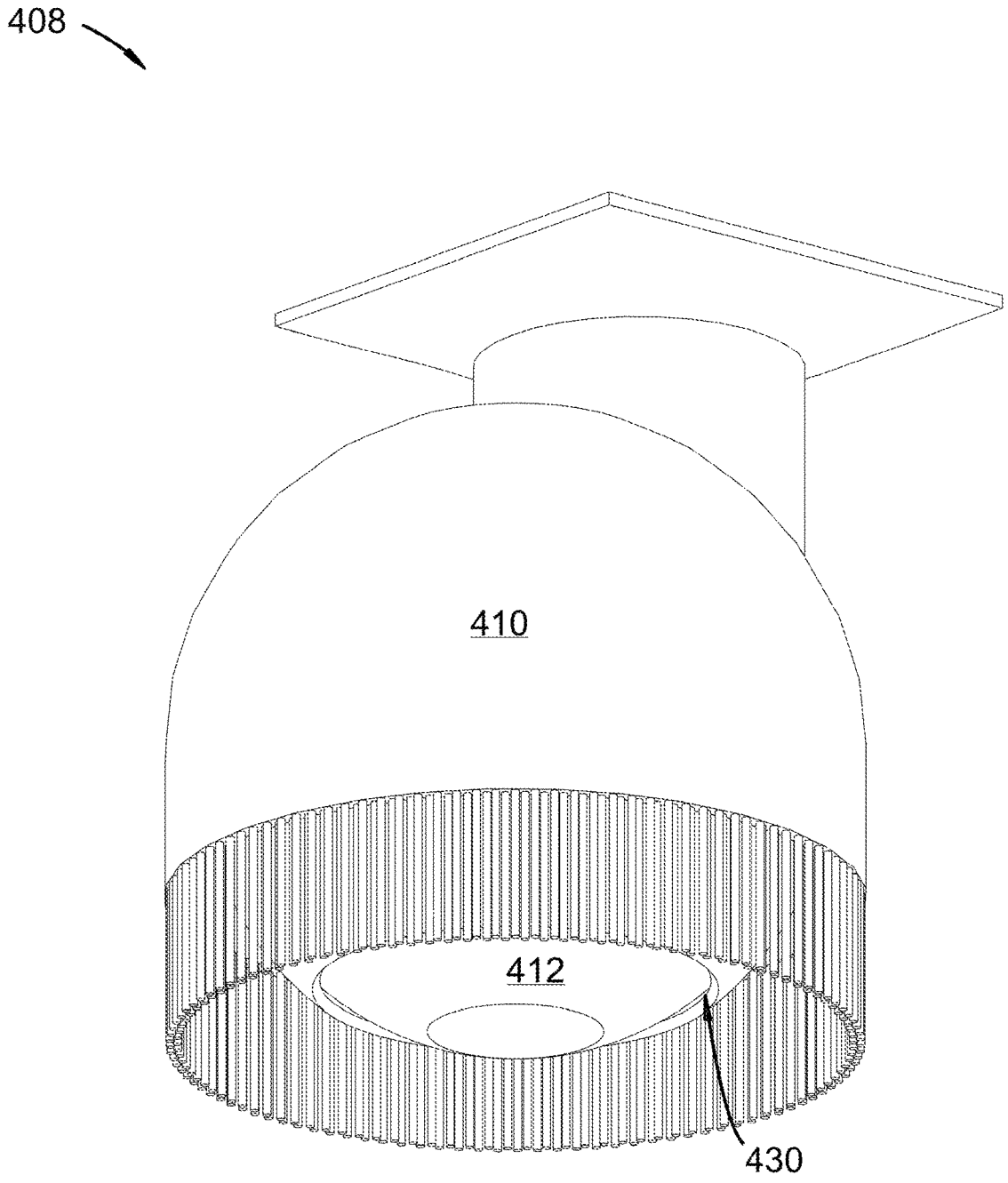
FIG. 4 depicts an embodiment similar to FIG. 3 with a ball-and-socket joint.

FIG. 4 depicts an embodiment similar to FIG. 3 with a ball-and-socket, joint. Wheel assembly 408 may include casing 410 and wheel 412. Casing 410 may include ball-and-socket joint 430. Wheel 412 may be connected to corresponding casing 410 via ball-and-socket joint 430, such that wheel 412 may rotate in any direction about a center of rotation. The wheel assembly may be illuminated by an LED device.

Figure 5:
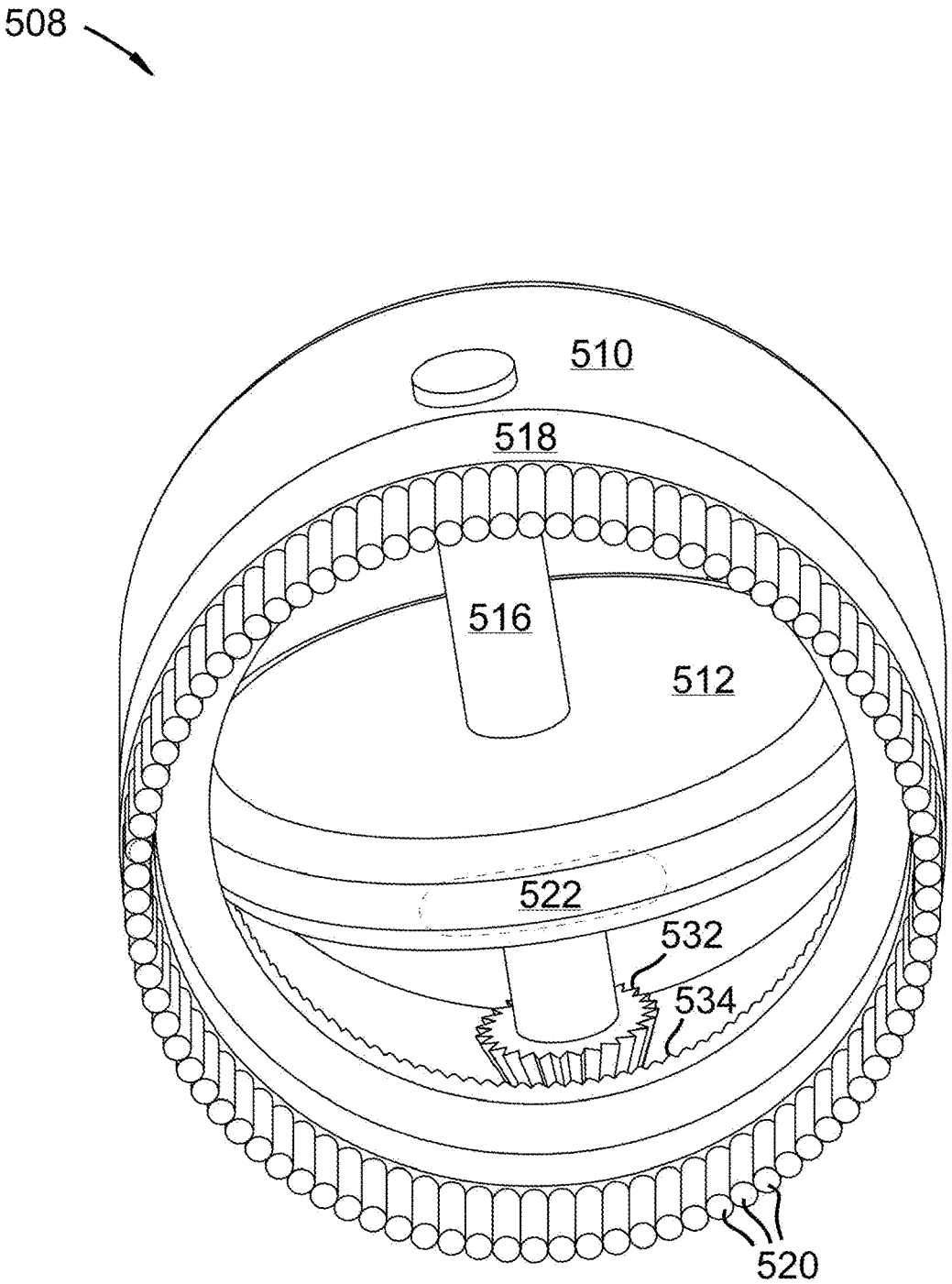
FIG. 5 depicts a bottom perspective view of a wheel assembly with a gear.

FIG. 5 depicts a bottom perspective view of a wheel assembly with a gear. Wheel assembly 508 may include axle 516, wheel 512, and casing 510. Axle 516 may include primary gear 532. Primary gear 532 may be attached to axle 516 such that gear 532 and axle 516 remain motionless relative to each other. For example, wheel 512 may cause axle 516 to rotate while gear 532 rotates with and remains motionless with respect to axle 516.

Brush 518 of wheel assembly 508 may include gear teeth 534. Gear teeth 534 may mesh with primary gear 532. Wheel 512 may be rotatably coupled to axle 516. For example, wheel assembly 508 may be attached to a chair base which may move relative to a floor. Contact patch 522 of wheel 512 may change with translation of wheel assembly 508 with respect to the floor such that wheel 512 rotates. Wheel 512 may cause axle 516 to rotate which, in turn, may cause primary gear 532 to rotate. Gear teeth 534 may rotate due to rotation of primary gear 532 such that brush 518 of wheel cleaner 514 rotates. Bristles 520 of brush 518 may subsequently brush aside debris from the floor around wheel assembly 508.

Figure 6:
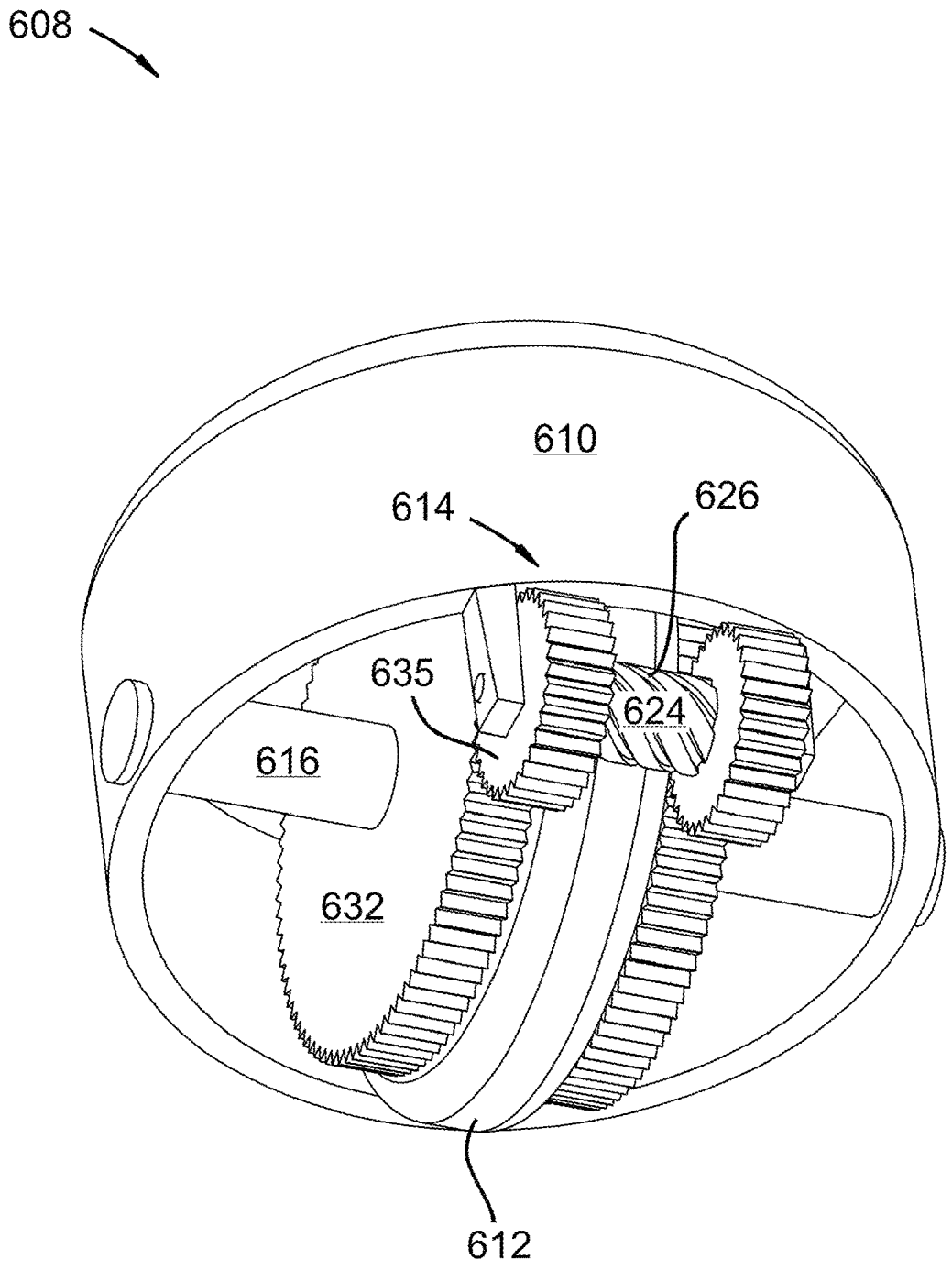
FIG. 6 depicts an embodiment similar to FIG. 5 with a scraper.

FIG. 6 depicts an embodiment similar to FIG. 5 with a scraper. Wheel assembly 608 may include axle 616, wheel 612, and casing 610. Axle 616 may include primary gear 632. Primary gear 632 may be attached to axle 616 such that primary gear 632 and axle 616 remain motionless relative to each other. For example, wheel 612 may cause axle 616 to rotate while primary gear 632 rotates with and remains motionless with respect to axle 616.

Scraper 624 of wheel assembly 608 may include secondary gear 635. Scraper 624 may be placed such that scraper blade 626 is positioned adjacent wheel 612. Secondary gear 635 may mesh with corresponding primary gear 632. Wheel 612 may be rotatably coupled to axle 616. For example, wheel assembly 608 may be attached to a chair base which may move relative to a floor. Contact patch 622 of wheel 612 may change with translation of wheel assembly 608 with respect to the floor such that wheel 612 rotates. Wheel 612 may cause axle 616 to rotate which, in turn, may cause primary gear 632 to rotate. Secondary gear 635 may rotate due to rotation of primary gear 632 such that scraper 624 of wheel cleaner 614 rotates. Scraper blade 626 of scraper 624 may subsequently remove debris from wheel 612.

Figure 7A:
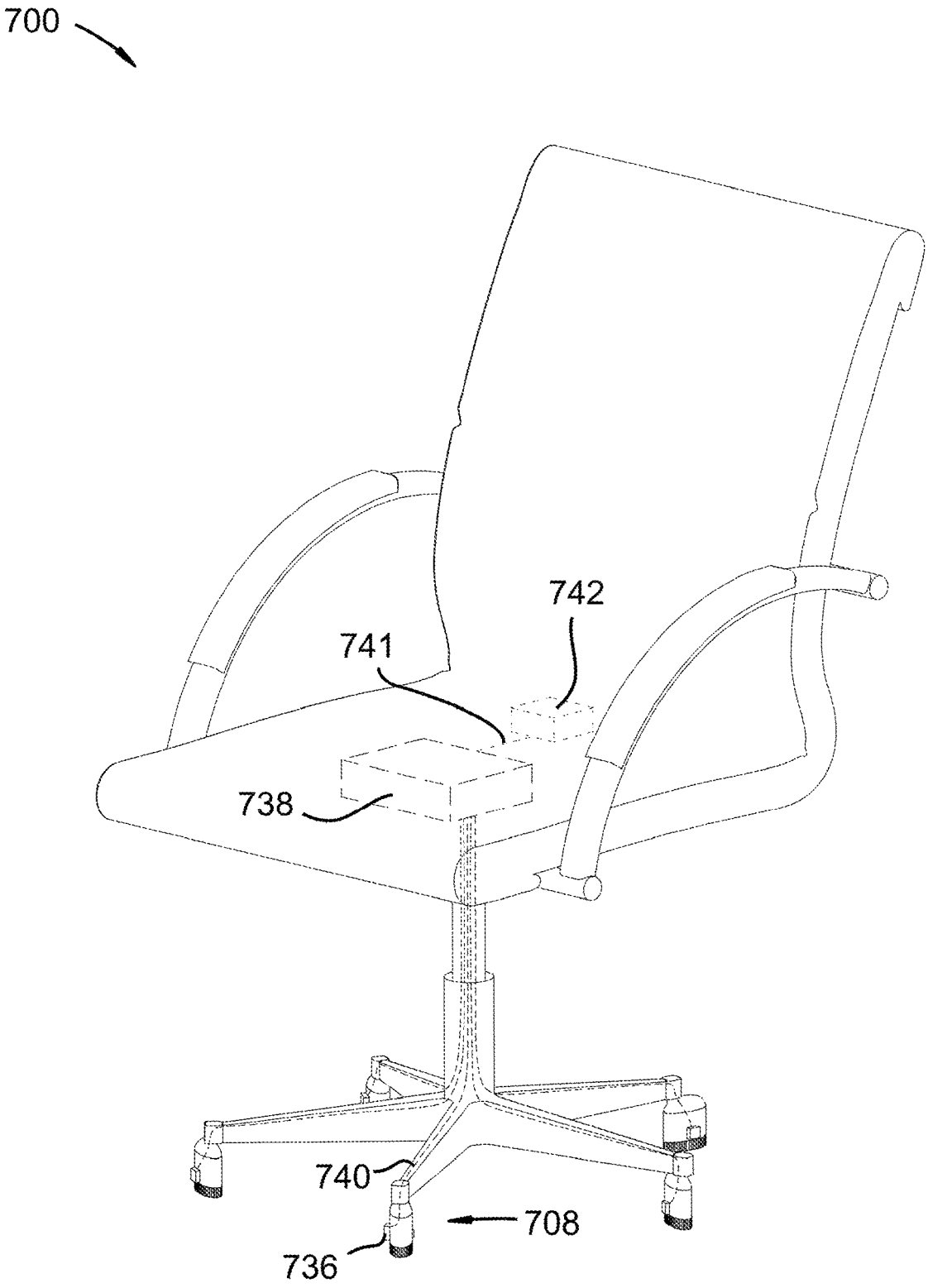
FIG. 7A depicts an embodiment similar to FIG. 1A with an energy harvester.
Figure 7B:
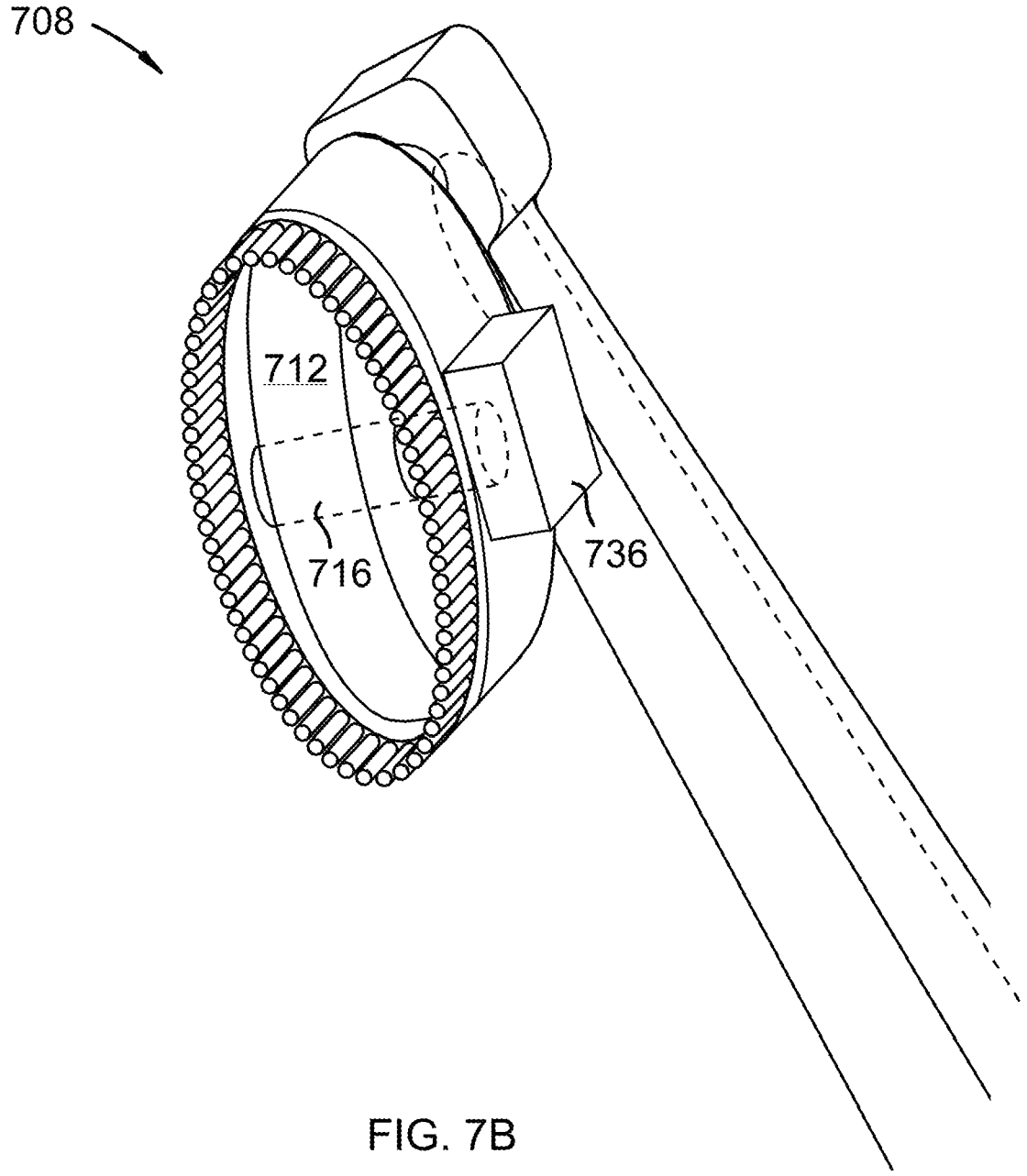
FIG. 7B depicts an embodiment similar to FIG. 1B with an energy harvester.

FIG. 7A depicts an embodiment similar to FIG. 1A with an energy harvester. FIG. 7B depicts an embodiment similar to FIG. 1B with an energy harvester. Wheel assembly 708 of wheel cleaning chair 700 may include axle 716 and energy harvester 736. Energy harvester 736 may be coupled to axle 716. Energy harvester 736 may include any of a variety of energy harvesting means, including electromechanical, piezoelectric, electromagnetic, or electro-capacitive means.

Wheel cleaning chair 700 may include energy storage device 738. Energy storage device 738 may be electrically connected to energy harvester 736 via wiring 740. For example, wheel cleaning chair 700 may be translated relative a surface in contact with wheel 712. Wheel 712 may rotate, subsequently rotating axle 716. Energy harvester 736 may subsequently harvest energy due to rotation of axle 716 and store the energy in energy storage device 738 via wiring 741. The energy storage device may be connected to an LED light for illumination of the wheel assembly.

Wheel cleaning chair 700 may include controller 742. Controller 742 may be electrically connected to energy harvester 736 via wiring 740.

Figure 8:
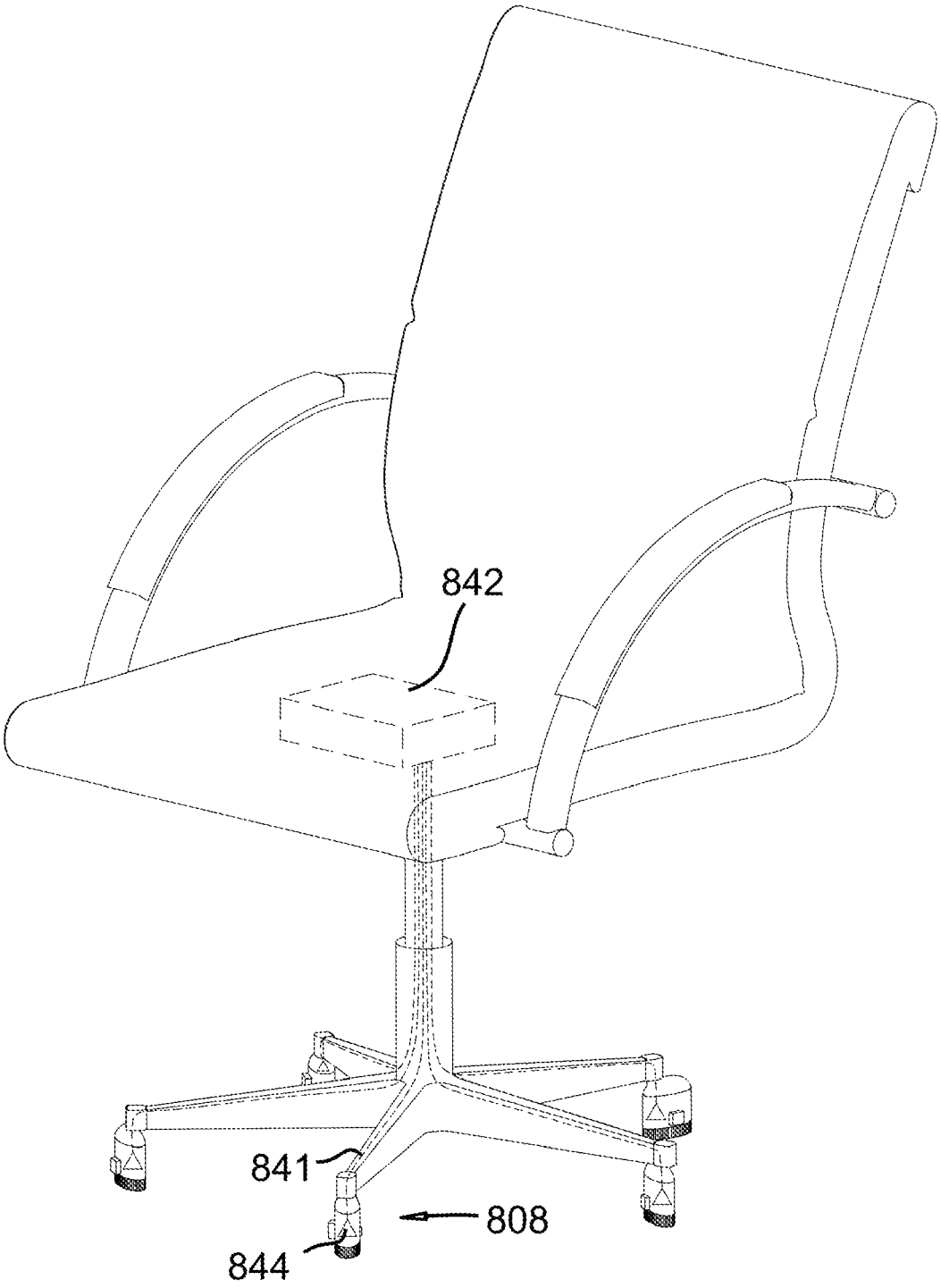
FIG. 8 depicts an embodiment similar to FIG. 7A with a light sensor.

FIG. 8 depicts an embodiment similar to FIG. 7A with a light sensor. Wheel assembly 808 may include light sensor 844. Light sensor 844 may be electrically connected to controller 842 via wiring 841 or wirelessly. Light sensor 844 may constantly or intermittently gather light data from wheel assembly 808 or from a surface such as a floor. Light sensor 844 may subsequently send the light data to controller 842, and controller 842 may store the light data. The light data may indicate whether wheel assembly 808 or a surface is relatively dirty.

Figure 9:
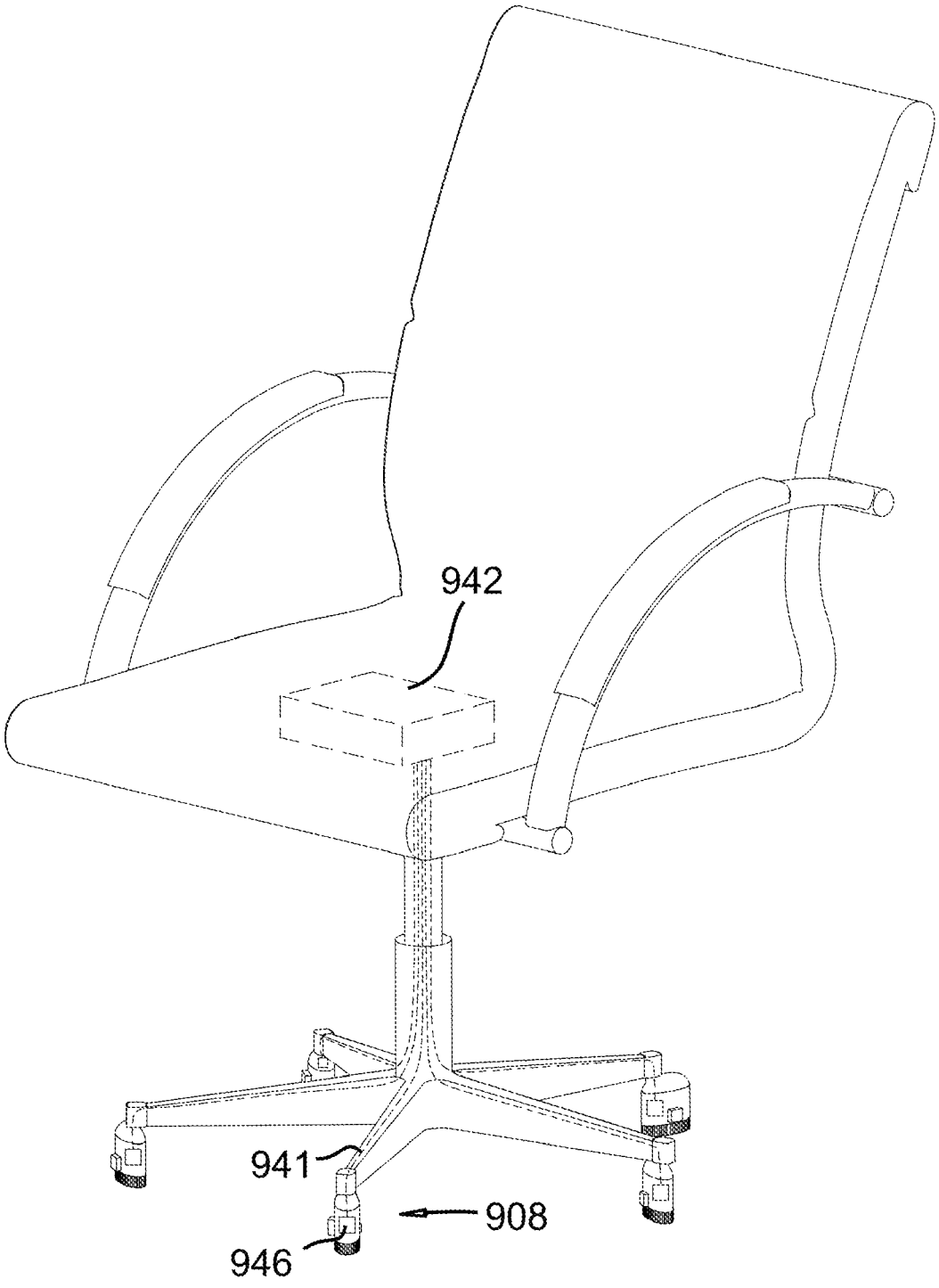
FIG. 9 depicts an embodiment similar to FIG. 8 with an audio sensor.

FIG. 9 depicts an embodiment similar to FIG. 8 with an audio sensor. Wheel assembly 908 may include audio sensor 946. Audio sensor 946 may be electrically connected to controller 942 via wiring 941 or wirelessly. Audio sensor 946 may constantly or intermittently gather audio data. Audio sensor 946 may subsequently send the audio data to controller 942, and controller 942 may store the audio data. The audio data may indicate whether debris such as rocks, sand, etc. are impeding functionality of wheel assembly 908.

Figure 10:
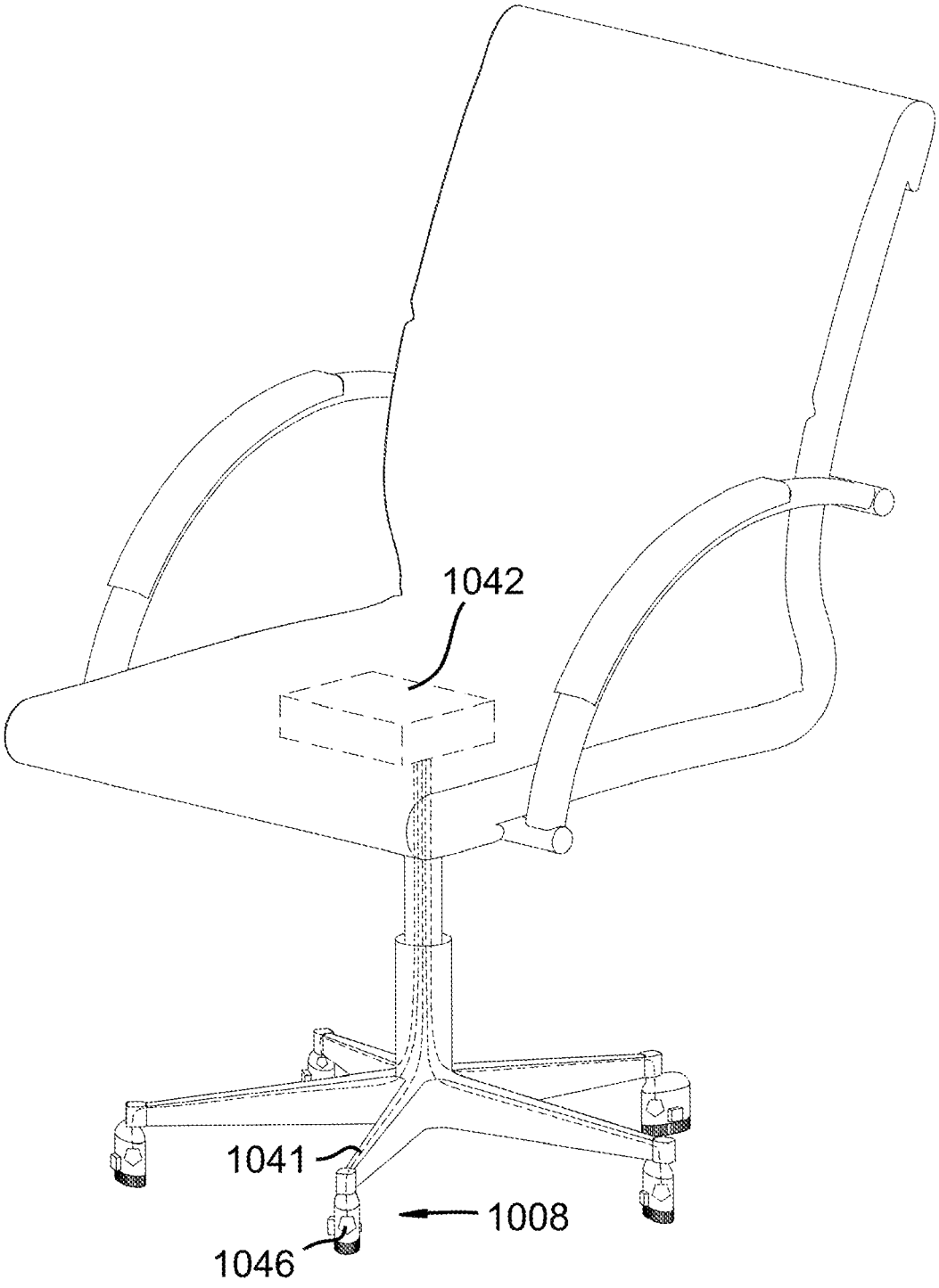
FIG. 10 depicts an embodiment similar to FIG. 9 with a particulate matter sensor.

FIG. 10 depicts an embodiment similar to FIG. 9 with a particulate matter sensor. Wheel assembly 1008 may include particulate matter (PM) sensor 1046. PM sensor 1046 may be electrically connected to controller 1042 via wiring 1041 or wirelessly. PM sensor 1046 may constantly or intermittently gather PM data. PM sensor 1046 may subsequently send the PM data to controller 1042, and controller 1042 may store the PM data. The PM data may indicate whether particulate matter such as dust is concentrated around wheel assembly 1008.

The invention claimed is:

1. A wheel cleaning chair comprising: a chair seat;
a chair base;
a column connecting the chair seat and the chair base;
the chair base comprising two or more wheel assemblies each comprising a wheel casing
and a wheel;
the wheel assemblies further comprising a wheel cleaner proximate each wheel;
and wherein at least one of the wheel assemblies comprises an axle connecting the wheel to the corresponding wheel casing and wherein the axle comprises a primary gear.

2. The wheel cleaning chair of claim 1, wherein at least one of the wheel cleaners comprises a bristle brush having bristles which extend to a contact patch of the corresponding wheel.

3. The wheel cleaning chair of claim 1, wherein at least one of the wheel cleaners comprises a scraper having a scraper blade.

4. The wheel cleaning chair of claim 1, wherein at least one of the wheel assemblies comprises a stem pivotally attached to the corresponding casing.

5. The wheel cleaning chair of claim 1, wherein at least one of the wheels is spherical.

6. The wheel cleaning chair of claim 5, wherein at least one of the wheels is connected to the corresponding casing via a ball-and-socket joint.

7. The wheel cleaning chair of claim 1, wherein the brush comprises gear teeth meshed with the primary gear.

8. The wheel cleaning chair of claim 7, wherein the scraper comprises a secondary gear meshed with the primary gear.

9. A wheel cleaning chair comprising: a chair seat;

a chair base;

a column connecting the chair seat and the chair base;

the chair base comprising two or more wheel assemblies each comprising a wheel casing and a wheel;

the wheel assemblies further comprising a wheel cleaner proximate each wheel;

wherein at least one of the wheel assemblies comprises an axle connecting the wheel to the corresponding wheel casing; and wherein at least one of the wheel assemblies comprises an energy harvester coupled to the axle.

10. The wheel cleaning chair of claim 9, comprising an energy storage device electrically connected to the energy harvester.

11. The wheel cleaning chair of claim 10, comprising a controller electrically connected to the energy storage device.

12. The wheel cleaning chair of claim 11, wherein at least one of the wheel assemblies comprises a light sensor electrically connected to the controller.

13. The wheel cleaning chair of claim 11, wherein at least one of the wheel assemblies comprises an audio sensor electrically connected to the controller.

14. The wheel cleaning chair of claim 11, wherein at least one of the wheel assemblies comprises a particulate matter (PM) sensor electrically connected to the controller.

15. A wheel cleaning chair comprising: a chair seat;

a chair base;

a column connecting the chair seat and the chair base;

the chair base comprising two or more wheel assemblies each comprising a wheel casing and a wheel;

the wheel assemblies further comprising a wheel cleaner proximate each wheel; and wherein at least one of the wheel assemblies comprise an LED wheel illuminator.

* * * * *